US007823253B2

(12) United States Patent
Kao et al.

(10) Patent No.: US 7,823,253 B2
(45) Date of Patent: Nov. 2, 2010

(54) SLIDABLE DUAL-AXIS HINGE ASSEMBLY

(75) Inventors: Wei-Chen Kao, Shulin (TW); Wen-Sung Ko, Shulin (TW)

(73) Assignee: Shin Zu Shing Co., Ltd., Shulin, Taipei Hsien (TW)

( * ) Notice: Subject to any disclaimer, the term of this patent is extended or adjusted under 35 U.S.C. 154(b) by 464 days.

(21) Appl. No.: 12/068,682

(22) Filed: Feb. 11, 2008

(65) Prior Publication Data

US 2009/0199361 A1 Aug. 13, 2009

(51) Int. Cl.
*E05D 7/06* (2006.01)

(52) U.S. Cl. ..... 16/239; 16/362; 16/357

(58) Field of Classification Search ..... 16/358, 16/359, 360, 361, 239, 242, 357, 352, 353, 16/362, 364; 455/575.4, 575.3; 379/433.01, 379/433.12, 433.13; 361/679.05, 679.27, 361/679.13, 679.56; 220/836, 835, 841, 220/845; 312/223.1, 223.2, 290, 220
See application file for complete search history.

(56) References Cited

U.S. PATENT DOCUMENTS 4,666,036 A * 5/1987 Bourbon ..... 206/45.23
5,742,475 A * 4/1998 Riddiford ..... 361/679.09
6,714,403 B2 * 3/2004 Furuki et al. ..... 361/679.09
6,856,505 B1 * 2/2005 Venegas et al. ..... 361/679.05
7,752,710 B2 * 7/2010 Lin ..... 16/334
2003/0137804 A1 * 7/2003 Chen et al. ..... 361/683
2004/0027808 A1 * 2/2004 Rumney ..... 361/724
2004/0244146 A1 * 12/2004 Park ..... 16/239
2007/0186380 A1 * 8/2007 Kim et al. ..... 16/239
2007/0243912 A1 * 10/2007 Lee et al. ..... 455/575.4
2007/0249394 A1 * 10/2007 Bong Doo ..... 455/556.1
2008/0051162 A1 * 2/2008 Kim et al. ..... 455/575.3
2008/0127455 A1 * 6/2008 Lee ..... 16/225
2008/0189908 A1 * 8/2008 Lowry et al. ..... 16/231
2009/0061956 A1 * 3/2009 Matsuoka ..... 455/575.1
2009/0279234 A1 * 11/2009 Lee ..... 361/679.01

FOREIGN PATENT DOCUMENTS

JP 2005061559 A * 3/2005

* cited by examiner

*Primary Examiner*—Chuck Y. Mah
(74) *Attorney, Agent, or Firm*—Bacon & Thomas, PLLC

(57) ABSTRACT

A slidable dual-axis hinge assembly has a sliding leaf and a stationary leaf. The sliding leaf has two detents and an outer pivot formed on a pivoting end of the sliding leaf and pivotally mounting the sliding leaf in a cover of a portable electronic device. The stationary leaf has an inner pivot formed on a proximal end of the stationary leaf and pivotally mounts the stationary leaf in a base of the portable electronic device, and has two slide brackets engaging the detents and defining two sliding grooves oppositely therein and being mounted around the side edges of the sliding leaf to allow the sliding leaf to slide relative to the stationary leaf. Thereby, the cover of the portable electronic device pivots relative to the base in two different positions.

8 Claims, 9 Drawing Sheets

SLIDABLE DUAL-AXIS HINGE ASSEMBLY

BACKGROUND OF THE INVENTION

1. Field of the Invention

The present invention relates to a hinge, and more particularly to a slidable dual-axis hinge assembly that allows a cover to slide and pivot relative to a base at different positions and has a simple structure to facilitate fabrication.

2. Description of Related Art

Portable electronic devices with hinged covers, such as notebook computers, cellular phones, portable movie players including DVD players and the like are commonly carried accessories. Generally, a portable electronic device comprises a base, a cover and at least one hinge. The cover may have a display mounted therein. The hinge pivotally connects the cover to the base and allows the cover to pivot relative to the base when the portable electronic device is in use.

To provide additional flexibility, hinges have been further developed to allow the cover to be rotated after being pivoted away from the base. However, as more and more functions or programs in the portable electronic device have been developed, hinges providing more flexibility of use are required.

To overcome the shortcomings, the present invention provides a slidable dual-axis hinge assembly to obviate or mitigate the aforementioned problems.

SUMMARY OF THE INVENTION

The main objective of the present invention is to provide a slidable dual-axis hinge assembly that allows a cover to slide and pivot relative to a base at different positions and has a simple structure to facilitate fabrication.

To achieve the objective, the slidable dual-axis hinge assembly in accordance with present invention comprises a sliding leaf and a stationary leaf.

The sliding leaf has two side edges, an outer pivot and two detents. The outer pivot is formed on a pivoting end of the sliding leaf and pivotally mounts the sliding leaf to a cover of a portable electronic device. The detents are formed oppositely near a sliding end.

The stationary leaf has an inner pivot and two slide brackets. The inner pivot is formed on a proximal end of the stationary leaf and pivotally mounts the stationary leaf in a base of the portable electronic device. The slide brackets oppositely define two sliding grooves therein, and being mounted around the side edges of the sliding leaf to allow the sliding leaf slide relative to the stationary leaf. Each slide bracket has at least one notch for engaging with one of the detents, thereby temporarily holding the sliding leaf in position relative to the stationary leaf.

In such a manner, the cover is able to pivot relative to the base via the outer pivot when the sliding leaf is in a position that the detents of the sliding leaf engage the slide brackets of the stationary leaf, or to pivot relative to the base via the inner pivot after the sliding leaf, with the cover, slides on the stationary leaf to allow the inner pivot to function. Accordingly, the cover of the portable electronic device pivots relative to the base in two different positions and thereby provides multiple specific applications to an electronic device.

Other objectives, advantages and novel features of the invention will become more apparent from the following detailed description when taken in conjunction with the accompanying drawings.

DETAILED DESCRIPTION OF THE PREFERRED EMBODIMENT

Figure 1:
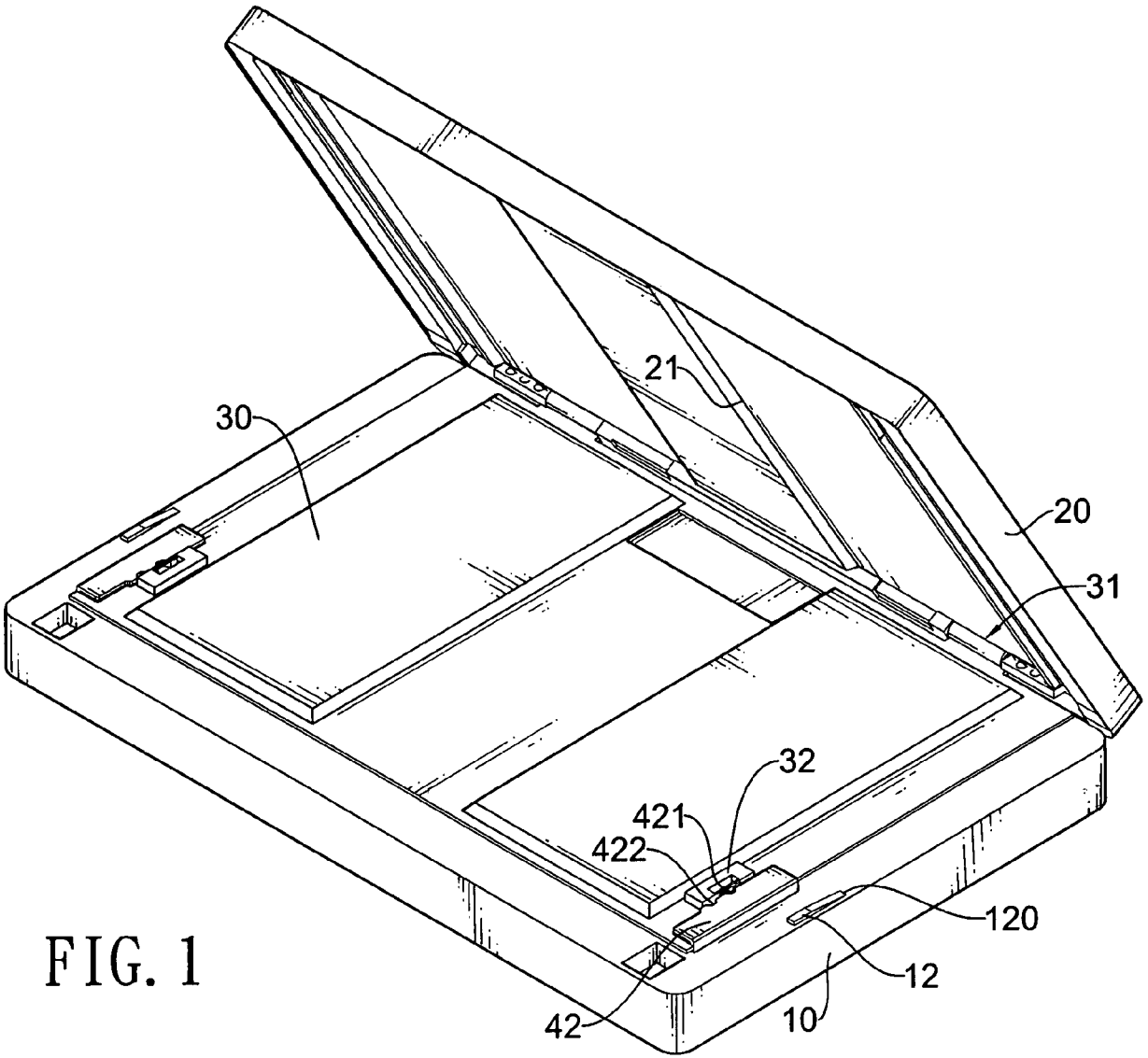
FIG. 1 is a rear perspective view of a slidable dual-axis hinge assembly in accordance with the present invention mounted in a portable electronic device.
Figure 2:
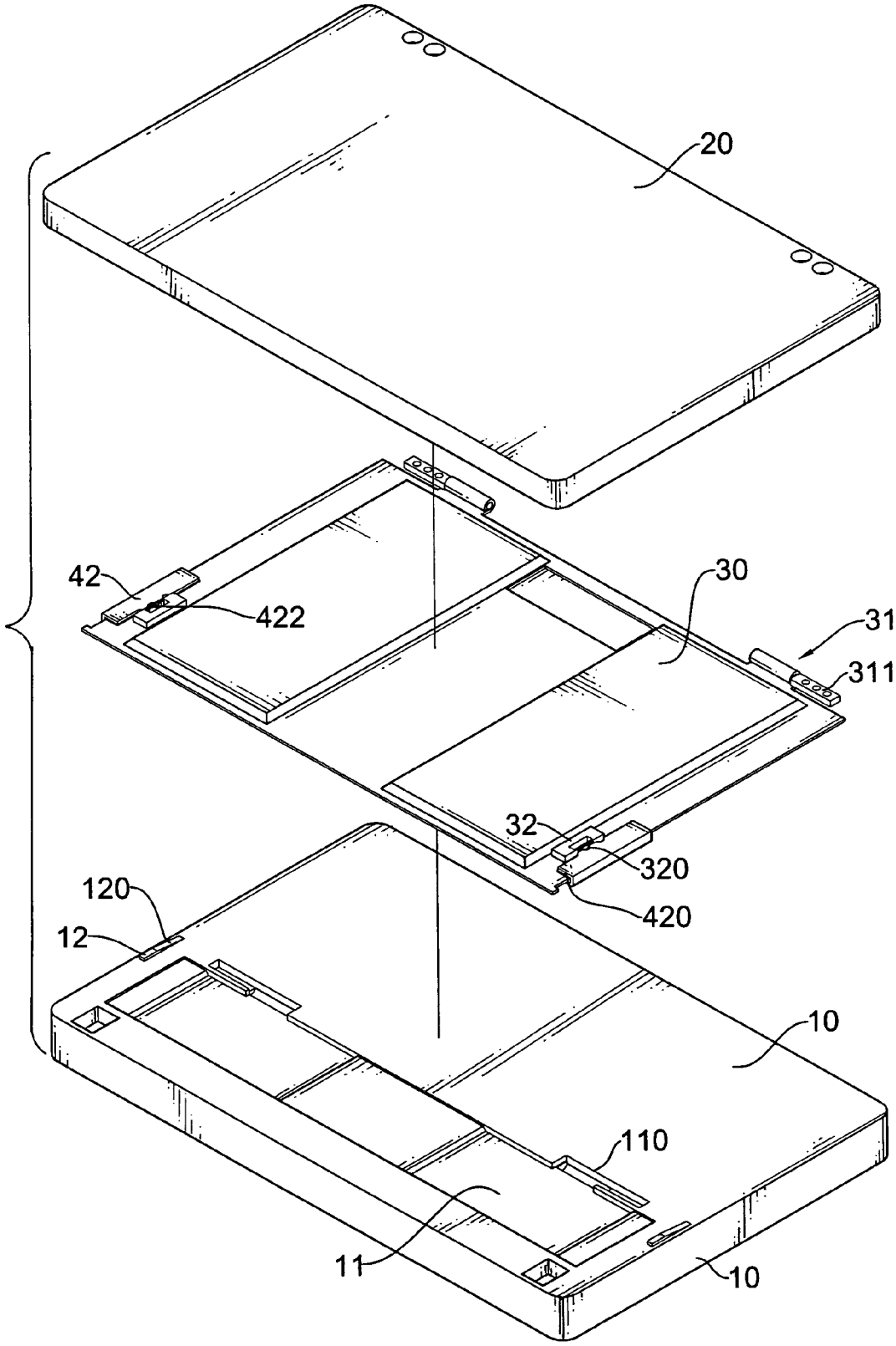
FIG. 2 is an exploded top-rear perspective view of the slidable dual-axis hinge assembly in FIG. 1 mounted in the portable electronic device.
Figure 3:
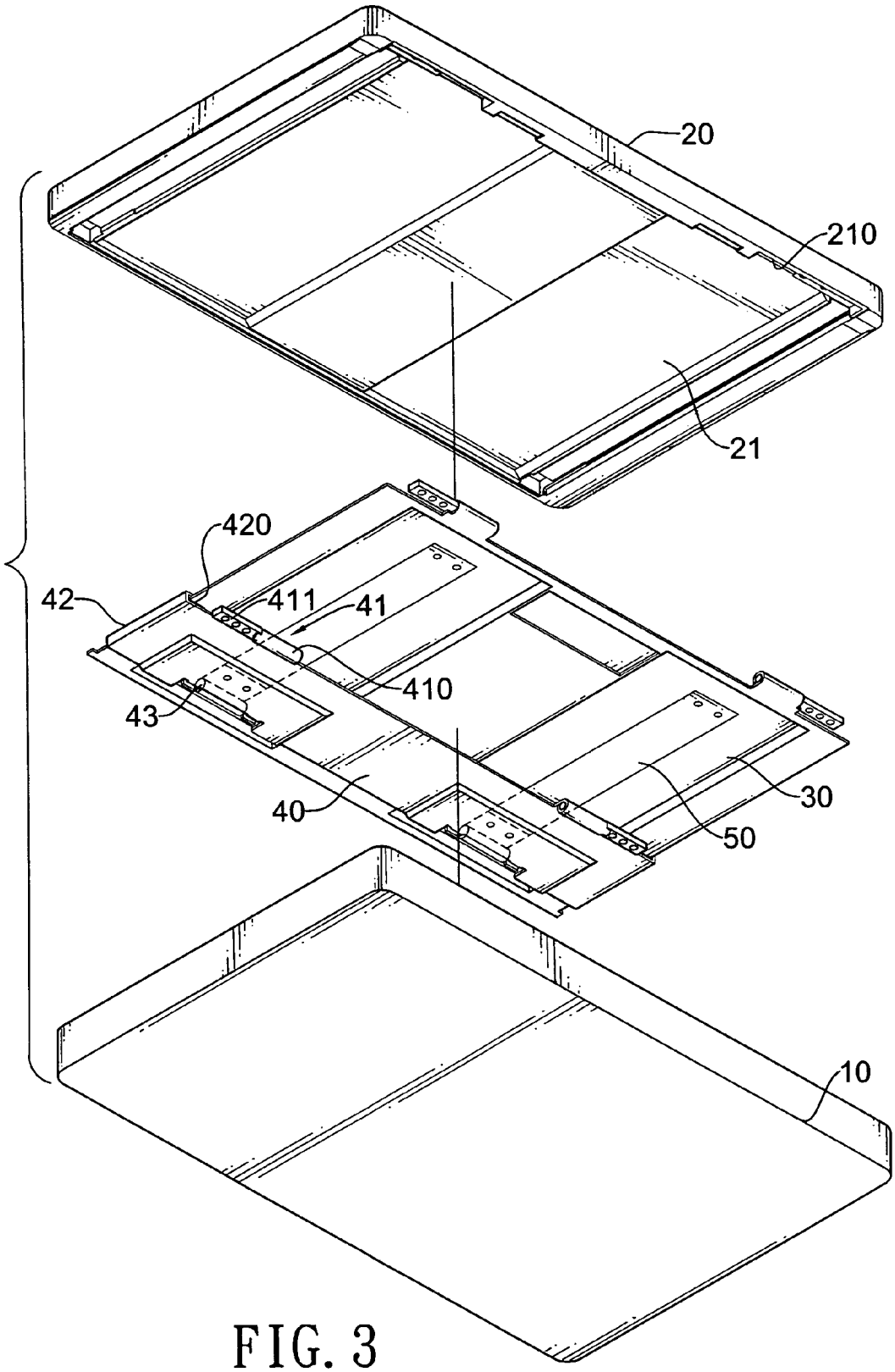
FIG. 3 is an enlarged, partially exploded rear-top perspective view of the slidable dual-axis hinge assembly in FIG. 1 mounted in the portable electronic device.

With reference to FIGS. 1, 2 and 3, a portable electronic device comprises a base (10) and a cover (20). The base (10) is temporarily mounted on a plane and has a top surface with two sides, a top recess (11) and two guides (12). The top recess (11) is defined in the top surface of the base (10) and has two mounting grooves (110). The mounting grooves (110) are formed adjacent to and communicate with the top recess (11). The guides (12) are formed respectively on the sides of the top surface of the base (10), each guide (12) has a slanted surface (120).

The cover (20) is mounted on the top surface of the base (10) and has a top surface, a bottom surface and a bottom recess (21). The top surface of the cover (20) may have a display mounted therein. The bottom recess (21) is defined in the bottom surface of the cover (20), has two mounting slots (210) and may have a magnetic inner surface. The mounting slots (210) are formed adjacent to and communicate with the bottom surface.

Figure 4:
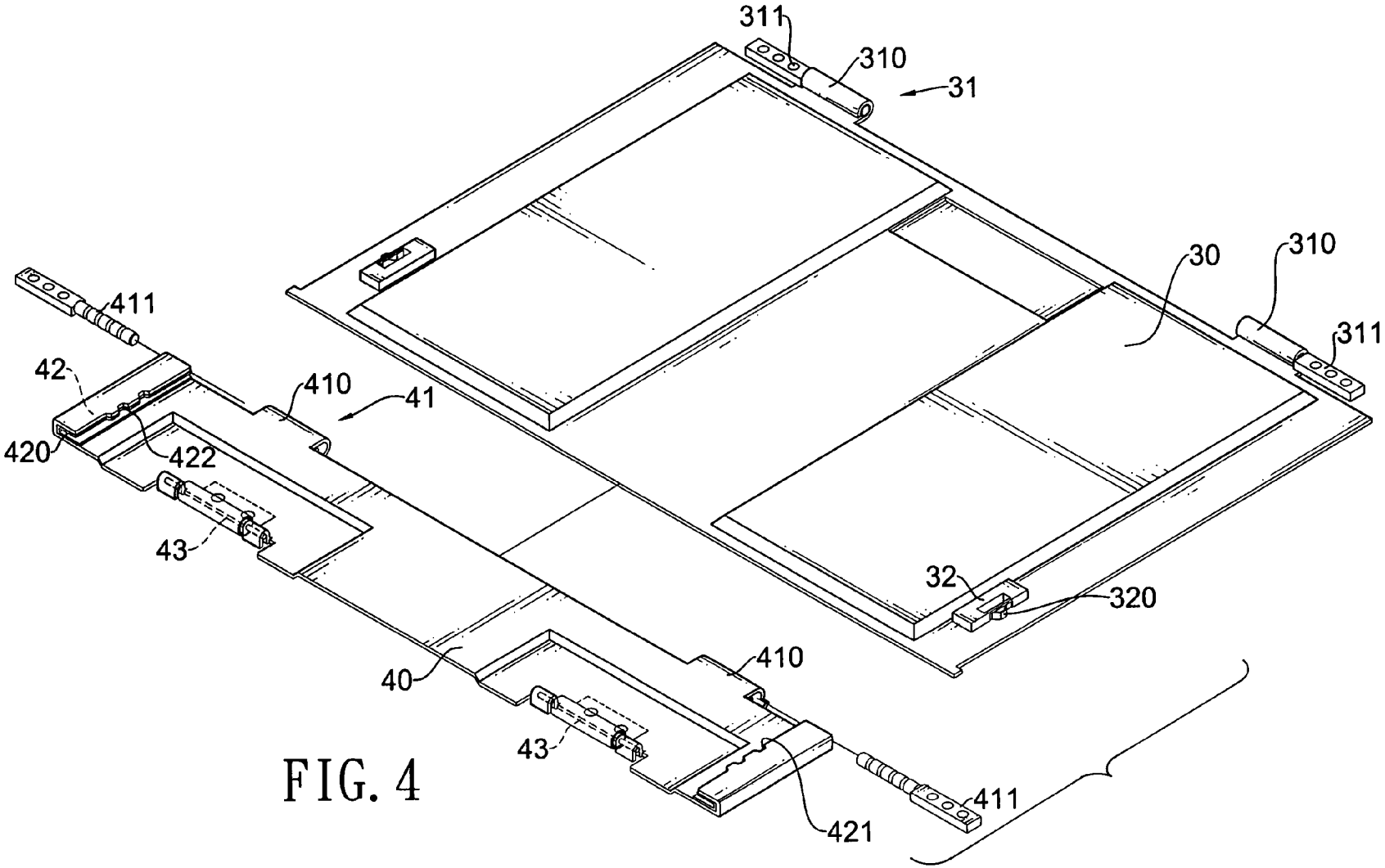
FIG. 4 is a partially exploded front-bottom perspective view of the slidable dual-axis hinge assembly in FIG. 1.
Figure 5:
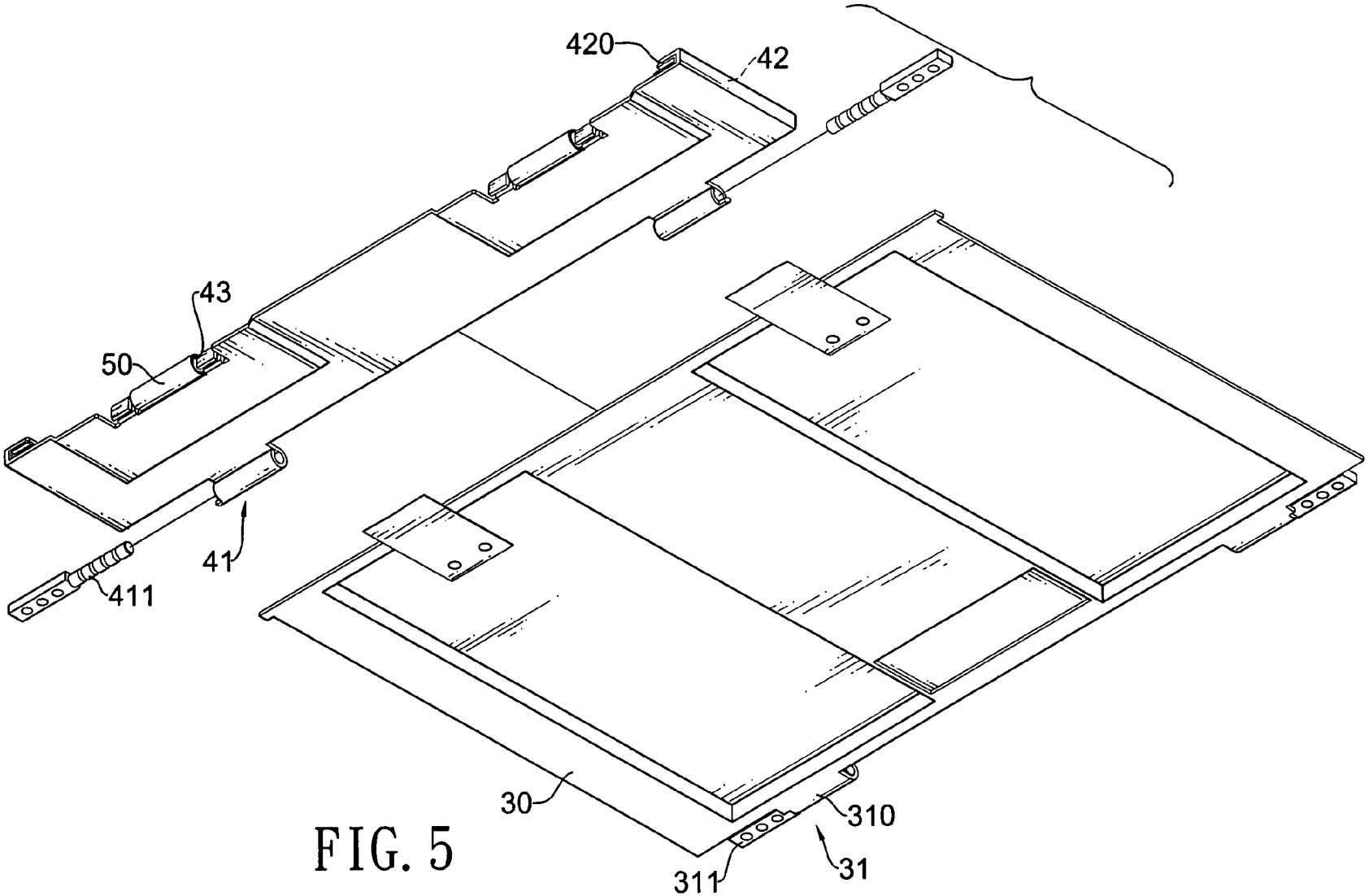
FIG. 5 is a partially exploded rear-bottom perspective view of the slidable dual-axis hinge assembly in FIG. 1.
Figure 6:
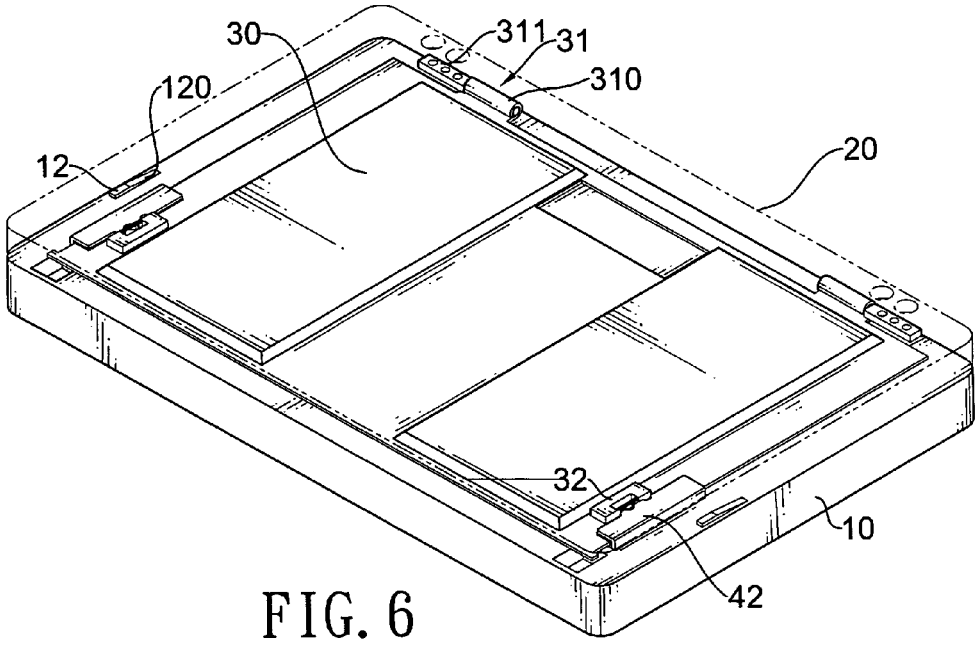
FIG. 6 is a rear-top perspective view of the slidable dual-axis hinge assembly in FIG. 1 mounted in the portable electronic device having a cover shown in phantom lines.

With reference to FIGS. 4, 5 and 6, the slidable dual-axis hinge assembly comprises a sliding leaf (30), a stationary leaf (40) and two resilient elements (50).

The sliding leaf (30) is mounted in the bottom recess (21) of the cover (20) and has a pivoting end, a sliding end, two side edges, a bottom surface, an outer pivot (31) and two detents (32). The outer pivot (31) is formed on the pivoting end of the sliding leaf (30) and has two outer barrels (310) and two outer pintles (311). The outer barrels (310) are separately formed on the pivoting end of the sliding leaf (30) and are respectively mounted in the mounting slots (210) of bottom recess (21) of the cover (20). The outer pintles (311) are rotatably mounted respectively in the outer barrels (310) of the outer pivot (31) and each outer pintle (311) has a connector being connected securely to the cover (20) to allow the cover (20) to pivot relative to the sliding leaf (30). The detents (32) are mounted oppositely near the sliding end of the sliding leaf (30) and each detent (32) may have a restricting protrusion (320) protruding out of a side surface of the detent (32). The sliding leaf (30) may be paramagnetic, and detachably attached to the magnetic inner surface of the bottom recess (21) of the cover (20).

The stationary leaf (40) is mounted in the top recess (11) of the base (10) and has a proximal end, an inner pivot (41), two slide brackets (42) and two spring mounts (43). The inner pivot (41) being formed on the proximal end of the stationary leaf (40) and has two inner barrels (410) and two inner pintles (411). The inner barrels (410) are separately formed securely on the proximal end of the stationary leaf (40) and are respectively mounted in the mounting grooves (110) of top recess (11) of the base (10). The inner pintles (411) are rotatably mounted respectively in the inner barrels (410) of the inner pivot (41) and each inner pintle (411) has a connector being connected securely to the base (10) to allow the stationary leaf (40) to pivot relative to the base (10). The slide brackets (42) oppositely define two sliding grooves (420) therein. The sliding grooves (420) are mounted around the side edges of the sliding leaf (30) to allow the sliding leaf (30) to slide relative to the stationary leaf (40). Each slide bracket (42) has at least one notch (421, 422) respectively formed therein for selectively engaging the restricting protrusion (320) of one of the detents (32), thereby temporarily holding the sliding leaf (30) in position relative to the stationary leaf (40). The spring mounts (43) are separately formed on the stationary leaf (40).

Figure 7:
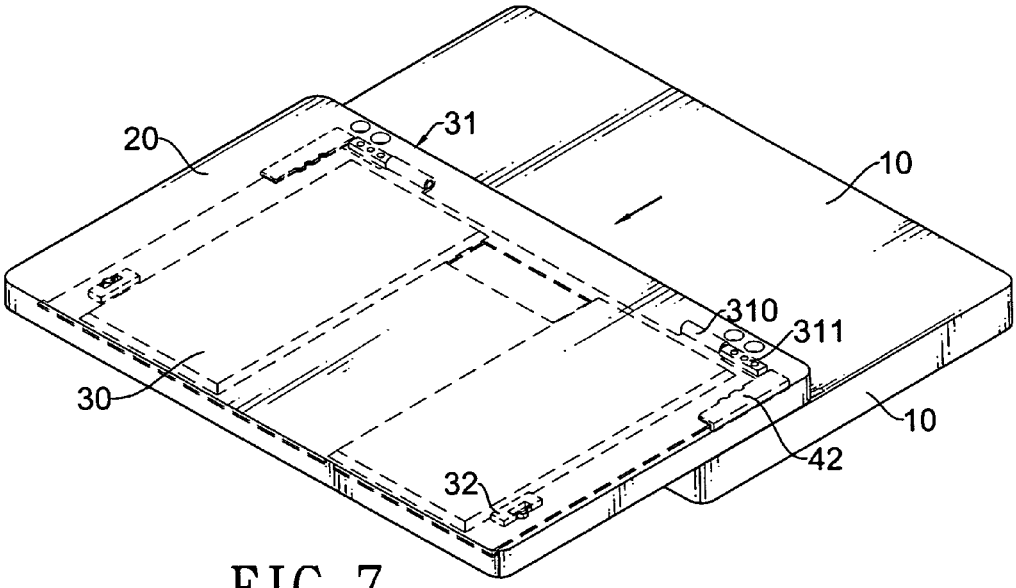
FIG. 7 is a rear-top perspective view of a first operational embodiment of the slidable dual-axis hinge assembly in FIG. 1 with internal elements shown in phantom lines and shown sliding.
Figure 8:
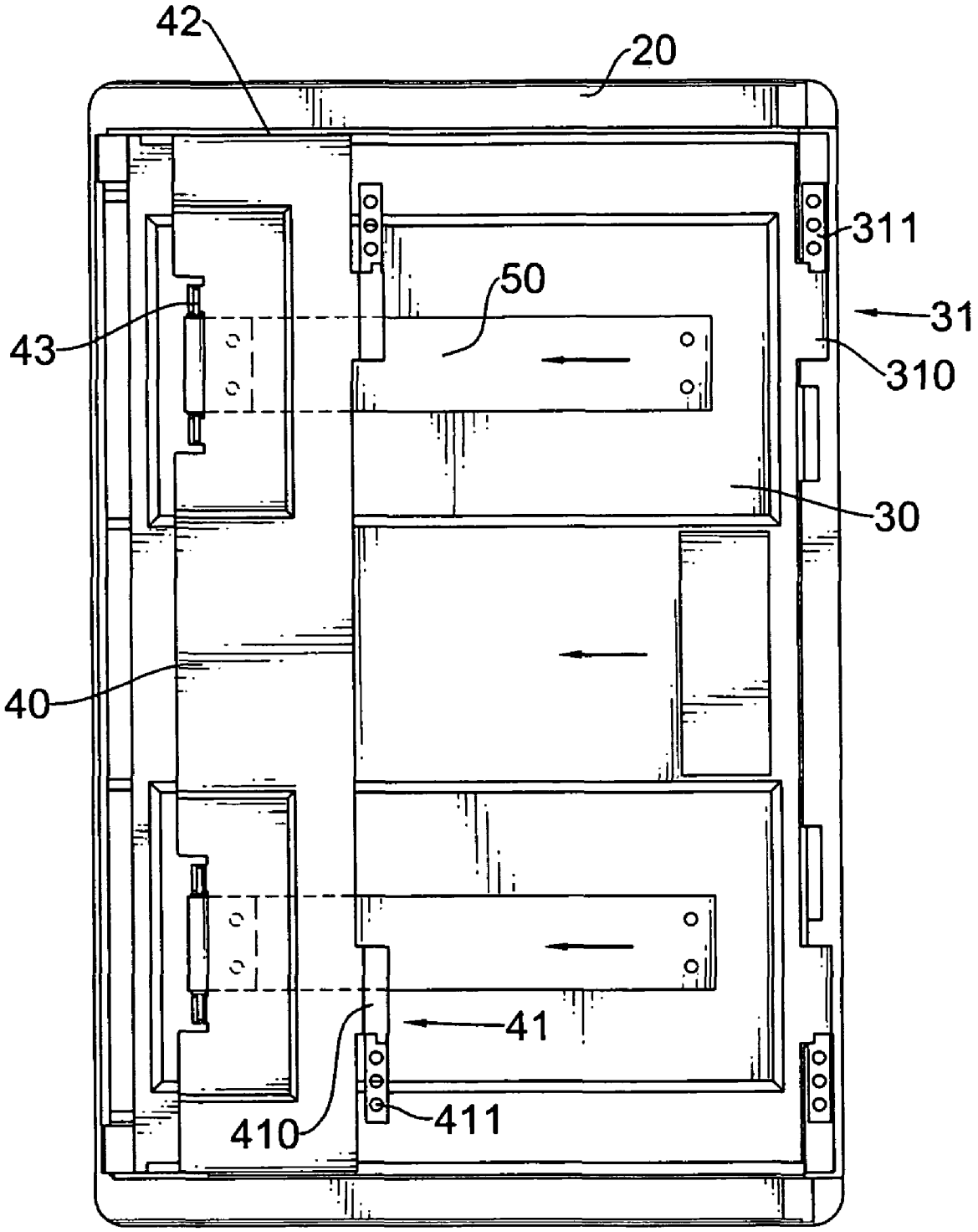
FIG. 8 is an operational bottom view of the slidable dual-axis hinge assembly in FIG. 1.

With further reference to FIGS. 6, 7 and 8, the resilient elements (50), may be coil springs, are connected to the bottom surface of the sliding leaf (30) and connected respectively to the spring mounts (43) of the stationary leaf (40). Once the detents (32) are released, the resilient elements (50) force the sliding leaf (30) to slide relative to the stationary leaf (40) so the inner pivot (41) of the stationary leaf (40) corresponds to the mounting grooves (110) of the base (10).

When the restricting protrusion (320) of the detent (32) is mounted in a first notch (422) of the slide bracket (42), the sliding leaf (30) is in the first position and neither the inner or outer pivots (31, 41) can move, so the cover (20) is held shut, this may be reinforced by magnetic attraction between the sliding leaf (30) and bottom recess (21) of the cover (20).

Figure 10:
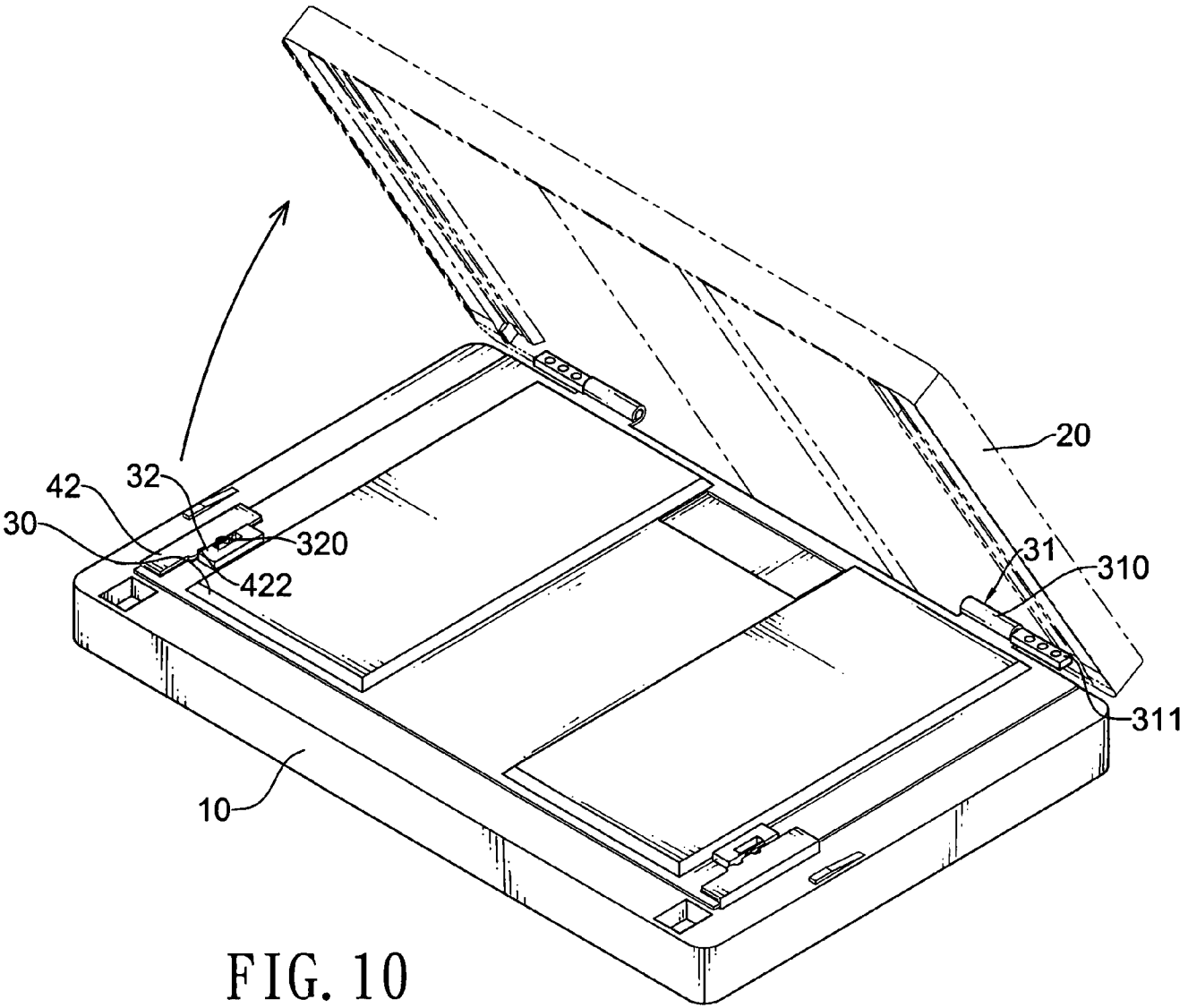
FIG. 10 is a top-rear perspective view of a second operational embodiment of the portable electronic device with the slidable dual-axis hinge assembly in FIG. 9, shown being pivoted.

With further reference to FIG. 10, when the restricting protrusion (320) of the detent (32) is mounted in the second notch (421) of the slide bracket (42), the sliding leaf (30) is in the second position and can be detached from the bottom recess (21) of the cover (20) and the cover (20) is able to pivot relative to the base (10) and be positioned using the outer pivot (31).

Figure 9:
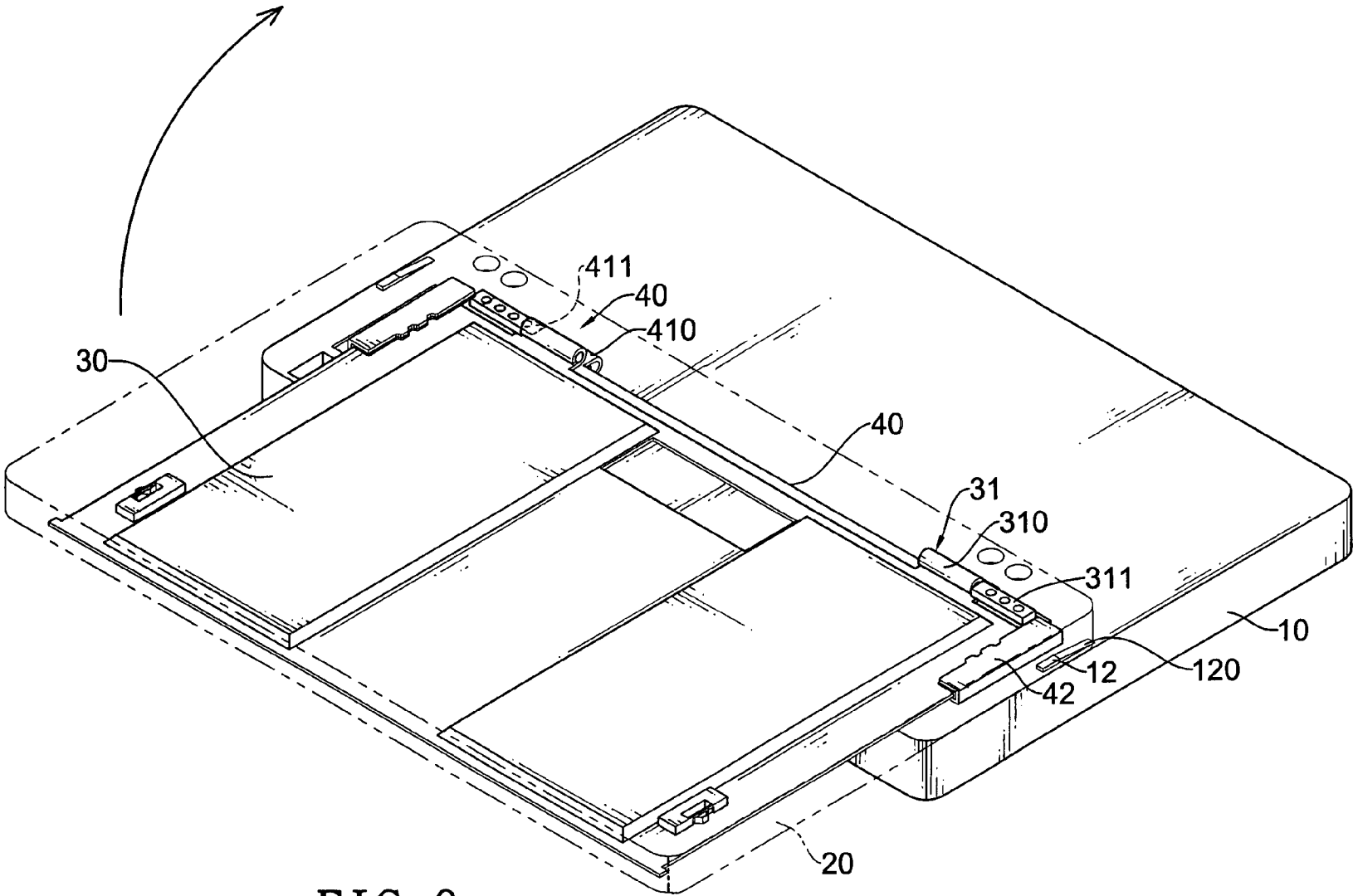
FIG. 9 is an operational rear-top perspective view of a first operational embodiment of the portable electronic device with the slidable dual-axis hinge assembly in FIG. 6 shown being opened.

With further reference to FIG. 9, once the detents (32) disengage from the first and second notches (421, 422) of the slide brackets (42), the sliding leaf (30) is pulled by the resilient element (50) to a third position where the inner pivot (41) of the stationary leaf (40) corresponds to the mounting grooves (110) of the base (10). Meanwhile, the slanted surfaces (120) of the guides (12) separate the cover (20) gradually away from the base (10). Therefore, the stationary leaf (40) holding the cover (20) is able to pivot relative to the base (10) and the cover (20) may be positioned via the inner pivot (41).

Accordingly, the cover (20) of the portable electronic device pivots relative to the base (10) in two different positions and thus provides different specific applications.

Even though numerous characteristics and advantages of the present invention have been set forth in the foregoing description together with details of the structure and function of the invention, the disclosure is illustrative only. Changes may be made in detail especially in matters of shape, size and arrangement of parts within the principles of the invention to the full extent indicated by the broad general meaning of the terms in which the appended claims are expressed.

What is claimed is:

1. A slidable dual-axis hinge assembly comprising a sliding leaf having a pivoting end;

a sliding end;

two side edges;

a bottom surface;

an outer pivot being formed on the pivoting end of the sliding leaf; and two detents being mounted oppositely near the sliding end of the sliding leaf for selectively engaging said sliding leaf, a stationary leaf having a proximal end;

an inner pivot formed on the proximal end of the stationary leaf;

two slide brackets oppositely defining two sliding grooves therein and receiving the side edges of the sliding leaf thereby allowing the sliding leaf to slide relative to the stationary leaf; and two spring mounts being separately formed on the stationary leaf; and two resilient elements, being connected to the bottom surface of the sliding leaf and connected respectively to the spring mounts of the stationary leaf.

2. The slidable dual-axis hinge assembly as claimed in claim 1, wherein each detent of the sliding leaf has a restricting protrusion protruding out of a side surface of the detent; and each slide bracket of the stationary leaf has at least one notch formed therein for selectively engaging the restricting protrusion of one of the detents, thereby temporarily holding the sliding leaf in position relative to the stationary leaf.

3. The slidable dual-axis hinge assembly as claimed in claim 1, wherein the outer pivot of the sliding leaf includes two outer barrels being separately formed on the pivoting end of the sliding leaf; and two outer pintles being rotatably mounted respectively in the outer barrels of the outer pivot and each pintle having a connector; and the inner pivot of the stationary leaf includes two inner barrels being separately formed on the proximal end of the stationary leaf; and two inner pintles being rotatably mounted respectively in the inner barrels of the inner pivot and each inner pintle having a connector.

4. The slidable dual-axis hinge assembly as claimed in claim 2, wherein the outer pivot of the sliding leaf includes two outer barrels being separately formed on the pivoting end of the sliding leaf; and two outer pintles being rotatably mounted respectively in the outer barrels of the outer pivot and each pintle having a connector; and the inner pivot of the stationary leaf includes two inner barrels being separately formed on the proximal end of the stationary leaf; and two inner pintles being rotatably mounted respectively in the inner barrels of the inner pivot and each inner pintle having a connector.

5. The slidable dual-axis hinge assembly as claimed in claim 1, wherein the resilient elements are coil springs.

6. The slidable dual-axis hinge assembly as claimed in claim 2, wherein the resilient elements are coil springs.

7. The slidable dual-axis hinge assembly as claimed in claim 3, wherein the resilient elements are coil springs.

8. The slidable dual-axis hinge assembly as claimed in claim 4, wherein the resilient elements are coil springs.

* * * * *